US011255130B2

(12) United States Patent
Moellendick et al.

(10) Patent No.: US 11,255,130 B2
(45) Date of Patent: Feb. 22, 2022

(54) SENSING DRILL BIT WEAR UNDER DOWNHOLE CONDITIONS

(71) Applicant: Saudi Arabian Oil Company, Dhahran (SA)

(72) Inventors: Timothy E. Moellendick, Dhahran (SA); Guodong Zhan, Dhahran (SA); Abdulwahab Al-Johar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/935,562

(22) Filed: Jul. 22, 2020

(65) Prior Publication Data

US 2022/0025714 A1 Jan. 27, 2022

(51) Int. Cl.

| | |
|---|---|
| ***E21B 12/02*** | (2006.01) |
| ***E21B 44/00*** | (2006.01) |
| ***E21B 47/013*** | (2012.01) |
| ***E21B 47/13*** | (2012.01) |

(52) U.S. Cl.

CPC ..... *E21B 12/02* (2013.01); *E21B 44/00* (2013.01); *E21B 47/013* (2020.05); *E21B 47/13* (2020.05)

(58) Field of Classification Search

CPC ..... E21B 12/02; E21B 47/013; E21B 47/01; E21B 47/017

See application file for complete search history.

(56) References Cited

U.S. PATENT DOCUMENTS

| | | | | |
|---|---|---|---|---|
| 891,957 A | | 6/1908 | Schubert | |
| 2,286,673 A | | 6/1942 | Douglas | |
| 2,305,062 A | | 12/1942 | Church et al. | |
| 2,344,120 A | | 3/1944 | Baker | |
| 2,757,738 A | | 9/1948 | Ritchey | |
| 2,509,608 A | | 5/1950 | Penfield | |
| 2,575,173 A | * | 11/1951 | Johnson | E21B 47/00 175/39 |
| 2,688,369 A | | 9/1954 | Broyles | |
| 2,719,363 A | | 10/1955 | Richard et al. | |
| 2,795,279 A | | 6/1957 | Erich | |
| 2,799,641 A | | 7/1957 | Gordon | |
| 2,805,045 A | | 9/1957 | Goodwin | |
| 2,841,226 A | | 7/1958 | Conrad et al. | |

(Continued)

FOREIGN PATENT DOCUMENTS

| | | |
|---|---|---|
| CA | 2669721 | 7/2011 |
| CN | 204627586 | 9/2015 |

(Continued)

OTHER PUBLICATIONS

"IADC Dull Grading for PDC Drill Bits," Beste Bit, SPE/IADC 23939, 1992, 52 pages.

(Continued)

*Primary Examiner* — Kristyn A Hall

(74) *Attorney, Agent, or Firm* — Fish & Richardson P.C.

(57) ABSTRACT

Methods and systems are described for drilling a wellbore. A method includes: sensing electrical resistance of an insulated conductor extending from a surface of a drill bit to a sensor inside the drill bit; calculating drill bit dimensions based on the sensed electrical resistance; and transmitting sensed electrical resistance, calculated drill bit dimensions, or both uphole to a system for controlling drilling operations.

14 Claims, 4 Drawing Sheets

(56) References Cited

U.S. PATENT DOCUMENTS 2,927,775 A 3/1960 Hildebrandt
3,016,244 A 1/1962 Friedrich et al.
3,028,915 A 4/1962 Jennings
3,087,552 A 4/1963 Graham
3,102,599 A 9/1963 Hillbum
3,103,975 A 9/1963 Hanson
3,104,711 A 9/1963 Haagensen
3,114,875 A 12/1963 Haagensen
3,133,592 A 5/1964 Tomberlin
3,137,347 A 6/1964 Parker
3,149,672 A 9/1964 Joseph et al.
3,169,577 A 2/1965 Erich
3,170,519 A 2/1965 Haagensen
3,211,220 A 10/1965 Erich
3,236,307 A 2/1966 Brown
3,268,003 A 8/1966 Essary
3,428,125 A 2/1969 Parker
3,522,848 A 8/1970 New
3,547,192 A 12/1970 Claridge et al.
3,547,193 A 12/1970 Gill
3,642,066 A 2/1972 Gill
3,656,564 A 4/1972 Brown
3,696,866 A 10/1972 Dryden
3,862,662 A 1/1975 Kern
3,874,450 A 4/1975 Kern
3,931,856 A 1/1976 Barnes
3,946,809 A 3/1976 Hagedorn
3,948,319 A 4/1976 Pritchett
4,008,762 A 2/1977 Fisher et al.
4,010,799 A 3/1977 Kern et al.
4,064,211 A 12/1977 Wood
4,084,637 A 4/1978 Todd
4,135,579 A 1/1979 Rowland et al.
4,140,179 A 2/1979 Kasevich et al.
4,140,180 A 2/1979 Bridges et al.
4,144,935 A 3/1979 Bridges et al.
4,191,493 A 3/1980 Hansson et al.
4,193,448 A 3/1980 Jearnbey
4,193,451 A 3/1980 Dauphine
4,196,329 A 4/1980 Rowland et al.
4,199,025 A 4/1980 Carpenter
4,265,307 A 5/1981 Elkins
RE30,738 E 9/1981 Bridges et al.
4,301,865 A 11/1981 Kasevich et al.
4,320,801 A 3/1982 Rowland et al.
4,334,928 A 6/1982 Hara
4,343,651 A 8/1982 Yazu et al.
4,354,559 A 10/1982 Johnson
4,373,581 A 2/1983 Toellner
4,394,170 A 7/1983 Sawaoka et al.
4,396,062 A 8/1983 Iskander
4,412,585 A 11/1983 Bouck
4,449,585 A 5/1984 Bridges et al.
4,457,365 A 7/1984 Kasevich et al.
4,470,459 A 9/1984 Copland
4,476,926 A 10/1984 Bridges et al.
4,484,627 A 11/1984 Perkins
4,485,868 A 12/1984 Sresty et al.
4,485,869 A 12/1984 Sresty et al.
4,487,257 A 12/1984 Dauphine
4,495,990 A 1/1985 Titus et al.
4,498,535 A 2/1985 Bridges
4,499,948 A 2/1985 Perkins
4,508,168 A 4/1985 Heeren
4,513,815 A 4/1985 Rundell et al.
4,524,826 A 6/1985 Savage
4,524,827 A 6/1985 Bridges et al.
4,545,435 A 10/1985 Bridges et al.
4,553,592 A 11/1985 Looney et al.
4,557,327 A 12/1985 Kinley et al.
4,576,231 A 3/1986 Dowling et al.
4,583,589 A 4/1986 Kasevich
4,592,423 A 6/1986 Savage et al.
4,612,988 A 9/1986 Segalman
4,620,593 A 11/1986 Haagensen
4,660,636 A 4/1987 Rundell et al.
4,705,108 A 11/1987 Little et al.
4,817,711 A 4/1989 Jearnbey
5,037,704 A 8/1991 Nakai et al.
5,055,180 A 10/1991 Klaila
5,068,819 A 11/1991 Misra et al.
5,082,054 A 1/1992 Kiamanesh
5,092,056 A 3/1992 Deaton
5,107,705 A 4/1992 Wraight et al.
5,107,931 A 4/1992 Valka et al.
5,228,518 A 7/1993 Wilson et al.
5,236,039 A 8/1993 Edelstein et al.
5,278,550 A 1/1994 Rhein-Knudsen et al.
5,388,648 A 2/1995 Jordan, Jr.
5,490,598 A 2/1996 Adams
5,501,248 A 3/1996 Kiest, Jr.
5,690,826 A 11/1997 Cravello
5,720,355 A * 2/1998 Lamine ..... E21B 10/60 175/27
5,803,666 A 9/1998 Keller
5,813,480 A 9/1998 Zaleski, Jr. et al.
5,853,049 A 12/1998 Keller
5,890,540 A 4/1999 Pia et al.
5,899,274 A 5/1999 Frauenfeld et al.
5,947,213 A 9/1999 Angle
5,958,236 A 9/1999 Bakula
RE36,362 E 11/1999 Jackson
6,012,526 A 1/2000 Jennings et al.
6,041,860 A 3/2000 Nazzal et al.
6,096,436 A 8/2000 Inspektor
6,170,531 B1 1/2001 Jung et al.
6,173,795 B1 1/2001 McGarian et al.
6,189,611 B1 2/2001 Kasevich
6,254,844 B1 7/2001 Takeuchi et al.
6,268,726 B1 7/2001 Prammer
6,269,953 B1 8/2001 Seyffert et al.
6,290,068 B1 9/2001 Adams et al.
6,325,216 B1 12/2001 Seyffert et al.
6,328,111 B1 12/2001 Bearden et al.
6,354,371 B1 3/2002 O'Blanc
6,371,302 B1 4/2002 Adams et al.
6,413,399 B1 7/2002 Kasevich
6,443,228 B1 9/2002 Aronstam
6,454,099 B1 9/2002 Adams et al.
6,510,947 B1 1/2003 Schulte et al.
6,534,980 B2 2/2003 Toufaily et al.
6,544,411 B2 4/2003 Varandaraj
6,561,269 B1 5/2003 Brown et al.
6,571,877 B1 6/2003 Van Bilderbeek
6,607,080 B2 8/2003 Winkler et al.
6,612,384 B1 9/2003 Singh et al.
6,623,850 B2 9/2003 Kukino et al.
6,629,610 B1 10/2003 Adams et al.
6,637,092 B1 10/2003 Menzel
6,678,616 B1 1/2004 Winkler et al.
6,722,504 B2 4/2004 Schulte et al.
6,761,230 B2 7/2004 Cross et al.
6,814,141 B2 11/2004 Huh et al.
6,845,818 B2 1/2005 Tutuncu et al.
6,850,068 B2 2/2005 Chemali et al.
6,895,678 B2 5/2005 Ash et al.
6,912,177 B2 6/2005 Smith
6,971,265 B1 12/2005 Sheppard et al.
6,993,432 B2 1/2006 Jenkins et al.
7,000,777 B2 2/2006 Adams et al.
7,013,992 B2 3/2006 Tessari et al.
7,048,051 B2 5/2006 McQueen
7,091,460 B2 8/2006 Kinzer
7,109,457 B2 9/2006 Kinzer
7,115,847 B2 10/2006 Kinzer
7,131,498 B2 11/2006 Campo et al.
7,216,767 B2 5/2007 Schulte et al.
7,312,428 B2 12/2007 Kinzer
7,322,776 B2 1/2008 Webb et al.
7,331,385 B2 2/2008 Symington
7,376,514 B2 5/2008 Habashy et al.
7,387,174 B2 6/2008 Lurie
7,445,041 B2 11/2008 O'Brien
7,455,117 B1 11/2008 Hall et al.

(56) References Cited

U.S. PATENT DOCUMENTS 7,461,693 B2 12/2008 Considine et al.
7,484,561 B2 2/2009 Bridges
7,562,708 B2 7/2009 Cogliandro et al.
7,629,497 B2 12/2009 Pringle
7,631,691 B2 12/2009 Symington et al.
7,650,269 B2 1/2010 Rodney
7,677,673 B2 3/2010 Tranquilla et al.
7,730,625 B2 6/2010 Blake
7,828,057 B2 11/2010 Kearl et al.
7,909,096 B2 3/2011 Clark et al.
7,951,482 B2 5/2011 Ichinose et al.
7,980,392 B2 7/2011 Varco
8,096,349 B2 1/2012 Considine et al.
8,210,256 B2 7/2012 Bridges et al.
8,237,444 B2 8/2012 Simon
8,245,792 B2 8/2012 Trinh et al.
8,275,549 B2 9/2012 Sabag et al.
8,484,858 B2 7/2013 Brannigan et al.
8,511,404 B2 8/2013 Rasheed
8,526,171 B2 9/2013 Wu et al.
8,528,668 B2 9/2013 Rasheed
8,567,491 B2 10/2013 Lurie
8,678,087 B2 3/2014 Schultz et al.
8,794,062 B2 8/2014 DiFoggio et al.
8,884,624 B2 11/2014 Homan et al.
8,925,213 B2 1/2015 Sallwasser
8,960,215 B2 2/2015 Cui et al.
9,109,429 B2 8/2015 Xu et al.
9,217,291 B2 12/2015 Batarseh
9,217,323 B2 12/2015 Clark
9,222,350 B2 12/2015 Vaughn et al.
9,250,339 B2 2/2016 Ramirez
9,394,782 B2 7/2016 DiGiovanni et al.
9,435,159 B2 9/2016 Scott
9,464,487 B1 10/2016 Zum
9,470,059 B2 10/2016 Zhou
9,494,032 B2 11/2016 Roberson et al.
9,528,366 B2 12/2016 Selman et al.
9,562,987 B2 2/2017 Guner et al.
9,567,819 B2 2/2017 Cavender et al.
9,664,011 B2 5/2017 Kruspe et al.
9,702,211 B2 7/2017 Tinnen
9,731,471 B2 8/2017 Schaedler et al.
9,739,141 B2 8/2017 Zeng et al.
9,765,609 B2 9/2017 Chemali et al.
10,000,983 B2 6/2018 Jackson et al.
10,174,577 B2 1/2019 Leuchtenberg et al.
10,233,372 B2 3/2019 Ramasamy et al.
10,394,193 B2 8/2019 Li et al.
2003/0159776 A1 8/2003 Graham
2003/0230526 A1 12/2003 Okabayshi et al.
2004/0182574 A1 9/2004 Sarmad et al.
2004/0256103 A1 12/2004 Batarseh
2005/0199386 A1 9/2005 Kinzer
2005/0259512 A1 11/2005 Mandal
2006/0016592 A1 1/2006 Wu
2006/0076347 A1 4/2006 Kinzer
2006/0102625 A1 5/2006 Kinzer
2006/0106541 A1 5/2006 Hassan et al.
2006/0144620 A1 7/2006 Cooper
2006/0185843 A1 8/2006 Smith
2006/0249307 A1 11/2006 Ritter
2007/0000662 A1 1/2007 Symington et al.
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0181301 A1 8/2007 O'Brien
2007/0187089 A1 8/2007 Bridges
2007/0193744 A1 8/2007 Bridges
2007/0204994 A1 9/2007 Wimmersperg
2007/0261844 A1 11/2007 Cogliandro et al.
2007/0289736 A1 12/2007 Kearl et al.
2008/0007421 A1 1/2008 Liu et al.
2008/0047337 A1 2/2008 Chemali et al.
2008/0073079 A1 3/2008 Tranquilla et al.
2008/0173443 A1 7/2008 Symington et al.
2008/0173480 A1 7/2008 Annaiyappa et al.
2008/0190822 A1 8/2008 Young
2008/0308282 A1 12/2008 Standridge et al.
2009/0164125 A1 6/2009 Bordakov et al.
2009/0178809 A1 7/2009 Jeffryes et al.
2009/0259446 A1 10/2009 Zhang et al.
2009/0288820 A1 11/2009 Barron et al.
2010/0089583 A1 4/2010 Xu et al.
2010/0186955 A1 7/2010 Saasen et al.
2010/0276209 A1 11/2010 Yong et al.
2010/0282511 A1 11/2010 Maranuk
2011/0011576 A1 1/2011 Cavender et al.
2011/0120732 A1 5/2011 Lurie
2012/0012319 A1 1/2012 Dennis
2012/0075615 A1 3/2012 Niclass et al.
2012/0111578 A1 5/2012 Tverlid
2012/0132418 A1 5/2012 McClung
2012/0169841 A1 6/2012 Chemali et al.
2012/0173196 A1 7/2012 Miszewski
2012/0181020 A1 7/2012 Barron et al.
2012/0222854 A1 9/2012 McClung, III
2012/0273187 A1 11/2012 Hall
2013/0008653 A1 1/2013 Schultz et al.
2013/0008671 A1 1/2013 Booth
2013/0025943 A1 1/2013 Kumar
2013/0076525 A1 3/2013 Vu et al.
2013/0125642 A1 5/2013 Parfitt
2013/0126164 A1 5/2013 Sweatman et al.
2013/0213637 A1 8/2013 Kearl
2013/0255936 A1 10/2013 Statoilydro et al.
2013/0270007 A1* 10/2013 Scott ..... C22C 26/00
175/40
2014/0034144 A1 2/2014 Cui et al.
2014/0083771 A1 3/2014 Clark
2014/0183143 A1 7/2014 Cady et al.
2014/0231147 A1 8/2014 Bozso et al.
2014/0246235 A1 9/2014 Yao
2014/0251894 A1 9/2014 Larson et al.
2014/0278111 A1 9/2014 Gertie et al.
2014/0291023 A1 10/2014 Edbury
2014/0333754 A1 11/2014 Graves et al.
2014/0360778 A1 12/2014 Batarseh
2014/0375468 A1 12/2014 Wilkinson et al.
2015/0020908 A1 1/2015 Warren
2015/0021240 A1 1/2015 Wardell et al.
2015/0083422 A1 3/2015 Pritchard
2015/0091737 A1 4/2015 Richardson et al.
2015/0101864 A1 4/2015 May
2015/0159467 A1 6/2015 Hartman et al.
2015/0211362 A1 7/2015 Rogers
2015/0267500 A1 9/2015 Van Dongen
2015/0290878 A1 10/2015 Houben et al.
2016/0053572 A1 2/2016 Snoswell
2016/0076357 A1 3/2016 Hbaieb
2016/0115783 A1 4/2016 Zeng et al.
2016/0153240 A1 6/2016 Braga et al.
2016/0160106 A1 6/2016 Jamison et al.
2016/0237810 A1 8/2016 Beaman et al.
2016/0247316 A1 8/2016 Whalley et al.
2016/0356125 A1 12/2016 Bello et al.
2017/0161885 A1 6/2017 Parmeshwar et al.
2017/0175520 A1 6/2017 Scott et al.
2017/0234104 A1 8/2017 James
2017/0292376 A1 10/2017 Kumar et al.
2017/0314335 A1 11/2017 Kosonde et al.
2017/0328196 A1 11/2017 Shi et al.
2017/0328197 A1 11/2017 Shi et al.
2017/0342776 A1 11/2017 Bullock et al.
2017/0350201 A1 12/2017 Shi et al.
2017/0350241 A1 12/2017 Shi
2018/0010030 A1 1/2018 Ramasamy et al.
2018/0010419 A1 1/2018 Livescu et al.
2018/0106922 A1 4/2018 Leuenberger et al.
2018/0171772 A1 6/2018 Rodney
2018/0187498 A1 7/2018 Soto et al.
2018/0265416 A1 9/2018 Ishida et al.
2018/0266226 A1 9/2018 Batarseh et al.

(56) References Cited

U.S. PATENT DOCUMENTS

| | | | |
|---|---|---|---|
| 2018/0326679 | A1 | 11/2018 | Weisenberg et al. |
| 2019/0049054 | A1 | 2/2019 | Gunnarsson et al. |
| 2019/0101872 | A1 | 4/2019 | Li |
| 2019/0227499 | A1 | 7/2019 | Li et al. |
| 2019/0257180 | A1 | 8/2019 | Kriesels et al. |
| 2019/0352973 | A1 | 11/2019 | Sehsah et al. |
| 2020/0032638 | A1 | 1/2020 | Ezzeddine |

FOREIGN PATENT DOCUMENTS

| | | |
|---|---|---|
| CN | 107462222 | 12/2017 |
| CN | 110571475 | 12/2019 |
| EP | 2317068 | 5/2011 |
| EP | 2574722 | 4/2013 |
| EP | 2737173 | 6/2014 |
| GB | 2357305 | 6/2001 |
| GB | 2399515 | 9/2004 |
| GB | 2422125 | 7/2006 |
| GB | 2532967 | 6/2016 |
| JP | 2009067609 | 4/2009 |
| JP | 4275896 | 6/2009 |
| JP | 5013156 | 8/2012 |
| NO | 343139 | 11/2018 |
| NO | 20161842 | 5/2019 |
| RU | 2282708 | 8/2006 |
| WO | WO 2000025942 | 5/2000 |
| WO | WO 2001042622 | 6/2001 |
| WO | WO 2002068793 | 9/2002 |
| WO | WO 2008146017 | 12/2008 |
| WO | WO 2009020889 | 2/2009 |
| WO | WO 2009113895 | 9/2009 |
| WO | WO 2010105177 | 9/2010 |
| WO | WO 2011038170 | 3/2011 |
| WO | WO 2011042622 | 6/2011 |
| WO | WO 2013016095 | 1/2013 |
| WO | WO 2013148510 | 10/2013 |
| WO | WO 2015011643 | 1/2015 |
| WO | WO 2015095155 | 6/2015 |
| WO | WO 2016178005 | 11/2016 |
| WO | WO 2017011078 | 1/2017 |
| WO | WO 2017132297 | 8/2017 |
| WO | WO 2018169991 | 9/2018 |
| WO | WO 2019040091 | 2/2019 |
| WO | WO 2019055240 | 3/2019 |
| WO | WO 2019089926 | 5/2019 |
| WO | WO 2019108931 | 6/2019 |
| WO | WO 2019169067 | 9/2019 |
| WO | WO 2019236288 | 12/2019 |
| WO | WO 2019246263 | 12/2019 |

OTHER PUBLICATIONS

Akersolutions, Aker MH CCTC Improving Safety, Jan. 2008.
Anwar et al.,"Fog computing: an overview of big IoT data analytics," Wireless communications and mobile computing, May 2018, 2018: 1-22.
Artymiuk et al., "The new drilling control and monitoring system," Acta Montanistica Slovaca, Sep. 2004, 9(3): 145-151.
Ashby et al., "Coiled Tubing Conveyed Video Camera and Multi-Arm Caliper Liner Damage Diagnostics Post Plug and Perf Frac," Society of Petroleum Engineers, SPE-172622-MS, Mar. 2015, pp. 12.
Bilal et al., "Potentials, trends, and prospects in edge technologies: Fog, cloudlet, mobile edge, and micro data centers," Computer Networks, Elsevier, Oct. 2017, 130: 94-120.
Carpenter, "Advancing Deepwater Kick Detection", JPT, vol. 68, Issue 5, May 2016, 2 pages.
Commer et al., "New advances in three-dimensional controlled-source electromagnetic inversion," Geophys. J. Int., 2008, 172: 513-535.
Dickens et al., "An LED array-based light induced fluorescence sensor for real-time process and field monitoring," Sensors and Actuators B: Chemical, Elsevier, Apr. 2011, 158(1): 35-42.
Dong et al., "Dual Substitution and Spark Plasma Sintering to Improve Ionic Conductivity of Garnet Li7La3Zr2O12," Nanomaterials, 9, 721, 2019, 10 pages.
downholediagnostic.com [online] "Acoustic Fluid Level Surveys," retrieved from URL <https://www.downholediagnostic.com/fluid-level> retrieved on Mar. 27, 2020, available on or before 2018, 13 pages.
edition.cnn.com [online], "Revolutionary gel is five times stronger than steel," retrieved from URL <https://edition.cnn.com/style/article/hydrogel-steel-japan/index.html>, retrieved on Apr. 2, 2020, available on or before Jul. 16, 2017, 6 pages.
Gemmeke and Ruiter, "3D ultrasound computer tomography for medical imagining," Nuclear Instruments and Methods in Physics Research A 580, Oct. 1, 2007, 9 pages.
Halliburton, "Drill Bits and Services Solutions Catalogs," retrieved from URL: <https://www.halliburton.com/content/dam/ps/public/sdbs/sdbs_contents/Books_and_Catalogs/web/DBS-Solution.pdI> on Sep. 26, 2019, Copyright 2014, 64 pages.
Ji et al., "Submicron Sized Nb Doped Lithium Garnet for High Ionic Conductivity Solid Electrolyte and Performance of All Solid-State Lithium Battery," doi:10.20944/preprints201912.0307.v1, Dec. 2019, 10 pages.
Johnson et al., "Advanced Deepwater Kick Detection," IADC/SPE 167990, presented at the 2014 IADC/SPE Drilling Conference and Exhibition, Mar. 4-6, 2014, 10 pages.
Johnson, "Design and Testing of a Laboratory Ultrasonic Data Acquisition System for Tomography" Thesis for the degree of Master of Science in Mining and Minerals Engineering, Virginia Polytechnic Institute and State University, Dec. 2, 2004, 108 pages.
King et al., "Atomic layer deposition of TiO2 films on particles in a fluidized bed reactor," Power Technology, vol. 183, Issue 3, Apr. 2008, 8 pages.
Li et al., 3D Printed Hybrid Electrodes for Lithium-ion Batteries, Missouri University of Science and Technology, Washington State University; ECS Transactions, 77 (11) 1209-1218 (2017), 11 pages.
Liu et al., "Flow visualization and measurement in flow field of a torque converter," Mechanic automation and control Engineering, Second International Conference on IEEE, Jul. 15, 2011, 1329-1331.
Liu et al., "Superstrong micro-grained poly crystalline diamond compact through work hardening under high pressure," Appl. Phys. Lett. Feb. 2018, 112: 6 pages.
nature.com [online], "Mechanical Behavior of a Soft Hydrogel Reinforced with Three-Dimensional Printed Microfibre Scaffolds," retrieved from URL <https://www.nature.com/articles/s41598-018-19502-y>, retrieved on Apr. 2, 2020, available on or before Jan. 19, 2018, 47 pages.
Nuth, "Smart oil field distributed computing," The Industrial Ethernet Book, Nov. 2014, 85(14): 1-3.
Olver, "Compact Antenna Test Ranges," Seventh International Conference on Antennas and Propagation IEEE , Apr. 15-18, 1991, 10 pages.
Parini et al., "Chapter 3: Antenna measurements," in Theory and Practice of Modem Antenna Range Measurements, IET editorial, 2014, 30 pages.
petrowiki.org [online], "Kicks," Petrowiki, available on or before Jun. 26, 2015, retrieved on Jan. 24, 2018, retrieved from URL <https://petrowiki.org/Kicks>, 6 pages.
Rigzone.com [online], "How does Well Control Work?" Rigzone, available on or before 1999, retrieved on Jan. 24, 2019, retrieved from URL <https://www.rigzone.com/training/insight.asp?insight_id=304&c_id>, 5 pages.
Ruiter et al., "3D ultrasound computer tomography of the breast: A new era?" European Journal of Radiology 81S1, Sep. 2012, 2 pages.
Sageoiltools.com [online] "Fluid Level & Dynamometer Instrumens for Analysis due Optimization of Oil and Gas Wells," retrieved from URL <http://www.sageoiltools.com/>, retrieved on Mar. 27, 2020, available on or before 2019, 3 pages.
Schlumberger, "First Rigless ESP Retrieval and Replacement with Slickline, Offshore Congo: Zeitecs Shuttle System Eliminates Need to Mobilize a Workover Rig," slb.com/zeitecs, 2016, 1 page.
Schlumberger, "The Lifting Business," Offshore Engineer, Mar. 2017, 1 page.

(56) References Cited

OTHER PUBLICATIONS

Schlumberger, "Zeitecs Shuttle System Decreases ESP Replacement Time by 87%: Customer ESP riglessly retrieved in less than 2 days on coiled tubing," slb.com/zeitecs, 2015, 1 page.
Schlumberger, "Zeitecs Shuttle System Reduces Deferred Production Even Before ESP is Commissioned, Offshore Africa: Third Party ESP developed fault during installation and was retrieved on rods, enabling operator to continue running tubing without waiting on replacement," slb.com/zeitecs, 2016, 2 pages.
Schlumberger, "Zeitecs Shuttle: Rigless ESP replacement system," Brochure, 8 pages.
Schlumberger, "Zeitecs Shuttle: Rigless ESP replacement system," Schlumberger, 2017, 2 pages.
Slb.com' [online] "Technical Paper: ESP Retrievable Technology: A Solution to Enhance ESP Production While Minimizing Costs," SPE 156189 presented in 2012, retrieved from URL <http://www.slb.com/resources/technical_papers/artificial_lift/156189.aspx>, retreived on Nov. 2, 2018, 1 pages.
Slb.com' [online], "Zeitecs Shuttle Rigless ESP Replacement System," retrieved from URL <http://www.slb.com/services/production/artificial_lift/submersible/zeitecs-shuttle.aspx?t=3>, available on or before May 31, 2017, retrieved on Nov. 2, 2018, 3 pages.
Sulzer Metco, "An Introduction to Thermal Spray," Issue 4, 2013, 24 pages.
Wei et al., "The Fabrication of All-Solid-State Lithium-Ion Batteries via Spark Plasma Sintering," Metals, 7, 372, 2017, 9 pages.
Wikipedia.org [online] "Optical Flowmeters," retireved from URL <https://en.wikipedia.org/wiki/Flow_measurement#Optical_flowmeters>, retrieved on Mar. 27, 2020, available on or before Jan. 2020, 1 page.
Wikipedia.org [online] "Ultrasonic Flow Meter," retrieved from URL <https://en.wikipedia.org/wiki/Ultrasonic_flow_meter> retrieved on Mar. 27, 2020, available on or before Sep. 2019, 3 pages.
Wikipedia.org [online], "Surface roughness," retrieved from URL <https://en.wikipedia.org/wiki/Surface_roughness> retrieved on Apr. 2, 2020, available on or before Oct. 2017, 6 pages.
Xue et al., "Spark plasma sintering plus heat-treatment of Ta-doped Li7La3Zr2O12 solid electrolyte and its ionic conductivity," Mater. Res. Express 7 (2020) 025518, 8 pages.
Zhan et al. "Effect of β-to-α Phase Transformation on the Microstructural Development and Mechanical Properties of Fine-Grained Silicon Carbide Ceramics." Journal of the American Ceramic Society 84.5, May 2001, 6 pages.
Zhan et al. "Single-wall carbon nanotubes as attractive toughening agents in alumina-based nanocomposites." Nature Materials 2.1, Jan. 2003, 6 pages.
Zhan et al., "Atomic Layer Deposition on Bulk Quantities of Surfactant Modified Single-Walled Carbon Nanotubes," Journal of American Ceramic Society, vol. 91, Issue 3, Mar. 2008, 5 pages.
Zhang et al, "Increasing Polypropylene High Temperature Stability by Blending Polypropylene-Bonded Hindered Phenol Antioxidant," Macromolecules, 51(5), pp. 1927-1936, 2018, 10 pages.
Zhu et al., "Spark Plasma Sintering of Lithium Aluminum Germanium Phosphate Solid Electrolyte and its Electrochemical Properties," University of British Columbia; Nanomaterials, 9, 1086, 2019, 10 pages.
PCT International Search Report and Written Opinion in International Appln. No. PCT/US2021/042792, dated Nov. 15, 2021, 16 pages.

* cited by examiner

SENSING DRILL BIT WEAR UNDER DOWNHOLE CONDITIONS

TECHNICAL FIELD

The present disclosure generally relates to wellbore drilling and, more particularly, to sensing drill bit wear in drilling tools used in the oil and gas industry.

BACKGROUND

Drilling wellbores in some formations poses challenging conditions, such as a diminished rate of penetration (ROP), drill bit vibrations, drill bit damage, and high pressure and high temperature (HPHT) conditions. The drilling conditions are appraised at the surface by a drilling advisor to determine appropriate drilling parameters, such as revolutions per minute (RPM) of the drill, weight on bit (WOB), and gallons per minute (GPM) of drilling mud pumped during drilling, in light of the perceived drilling conditions.

SUMMARY

This specification describes downhole drilling systems and methods that can be used to monitor and predict the condition of a drill bit in drilling tools during wellbore drilling. The drill bit is disposed at the end of the drilling system to drill the downhole formation. This drill bit includes a body, two or more blades, and a sensor module embedded in the drill bit. In some examples, the sensor module is embedded into the body of the drill bit. The sensor module includes sensors, instrumentation and signal processing circuits, batteries, insulated conductors, receivers, transmitters, and data storing and processing devices. During a drilling operation, the sensor module measures the electrical or field properties (e.g., acoustic and capacitive properties) that are used to monitor and evaluate the condition of the drill bit.

The drill bit with an onboard sensor module enables virtual drill bit grading (i.e., assessment of drill bit condition) and improved drilling automation. The data from the sensors can be transferred to the data processing system to improve and automate the drilling operation. The onboard sensor module can measure and predict condition of the drill bit. This allows the user to have more confidence when correlating damage reduction to specific drill bit features and enables continuous process improvement.

In some aspects, a method for drilling a wellbore includes: sensing electrical resistance of an insulated conductor extending from a surface of a drill bit to a sensor inside the drill bit; calculating drill bit dimensions based on the sensed electrical resistance; and transmitting sensed electrical resistance, calculated drill bit dimensions, or both uphole to a system for controlling drilling operations.

Embodiments of the method for drilling a wellbore can include one or more of the following features.

In some embodiments, the method includes correlating rate of penetration with drill bit dimensions. In some cases, the method includes calculating lost time associated with reductions in drill bit dimensions. In some cases, the method includes comparing the lost time associated with reductions in drill bit dimensions with non-productive time associated with replacing the drill bit. In some cases, the method includes calculating time until drill bit replacement is required based on a rate of reduction of drill bit dimensions.

In some embodiments, the method includes updating a drilling plan based on the calculated drill bit dimensions.

In some embodiments, the method includes providing calculated drill bit dimensions as input to a drilling automation algorithm.

In some aspects, a system for drilling wellbores includes: a drill bit including: an electrical resistance sensor disposed inside the drill bit; two insulated conductors extending from a surface of the drill bit to the sensor; and an onboard computer operable to calculate drill bit dimensions based on electrical resistance measured by the electrical resistance sensor.

Embodiments of the system for drilling wellbores can include one or more of the following features.

In some embodiments, the insulated conductors include copper with insulating materials disposed between the copper and a body of the drill bit. In some cases, the two insulated conductors have the same dimensions and extend in parallel from the surface of the drill bit to the sensor.

In some embodiments, the system includes a data processing system operable to control drilling operations, the data processing system in electronic communication with the onboard computer. In some cases, the data processing system is configured to receive sensed electrical resistance, calculated drill bit dimensions, or both from the onboard computer. In some cases, the data processing system includes algorithms to correlate drilling rate of penetration with drill bit dimensions. In some cases, the data processing system includes algorithms to calculate lost time associated with reductions in drill bit dimensions. In some cases, the data processing system includes algorithms to compare the lost time associated with reductions in drill bit dimensions with non-productive time associated with replacing the drill bit. In some cases, the data processing system includes algorithms to calculate time until drill bit replacement is required based on a rate of reduction of drill bit dimensions.

In some embodiments, the onboard computer is a printed circuit board.

In some embodiments, the system includes a battery electrically connected to the onboard computer and the sensor.

The prediction of the drill bit grade or condition is done during drilling while the drill bit is downhole. This approach can be used to adjust the drilling automation algorithms for improved drilling performance based on measured data in real-time and can improve the economics of drilling operations. Drill bit condition affects the invisible lost time (e.g., time lost associated with decreases in the rate of penetration due to increased wear on the drill bit). Wear of the drill bit eventually requires a replacement of the drill bit and causes non-productive time associated with tripping the drill string out of and back into the wellbore for the replacement of the drill bit. Understanding the exact drill bit conditions further reduces cost by reducing the invisible lost time and the non-productive time that constitute a significant portion of the overall drilling costs. For example, the ability to accurately predict the drill bit grade can guide decisions on when it is time to trip the drill bit and replace it instead of continuing to drill with a damaged tool. Knowing the exact bit conditions can improve the ROP, extend the drill bit life, guide drilling practices, improve trip plans, enhance drill bit design, and automate drilling operations.

The details of one or more embodiments of these systems and methods are set forth in the accompanying drawings and the description below. Other features, objects, and advantages of these systems and methods will be apparent from the description and drawings, and from the claims.

DETAILED DESCRIPTION

This specification describes downhole drilling systems and methods that can be used to monitor and predict the condition of a drill bit in drilling tools during wellbore drilling. The drill bit is disposed at the end of the drilling system to drill the downhole formation. This drill bit includes a body, two or more blades, and a sensor module that is embedded into the drill bit blade. In some examples, the sensor module is embedded into the body of the drill bit. The sensor module includes sensors, instrumentation and signal processing circuits, batteries, insulated conductors, receivers, transmitters, and data storing and processing devices. During a drilling operation, the sensor module measures the electrical or field properties (e.g., acoustic and capacitive properties) that are used to monitor and evaluate the condition of the drill bit.

Figure 1:
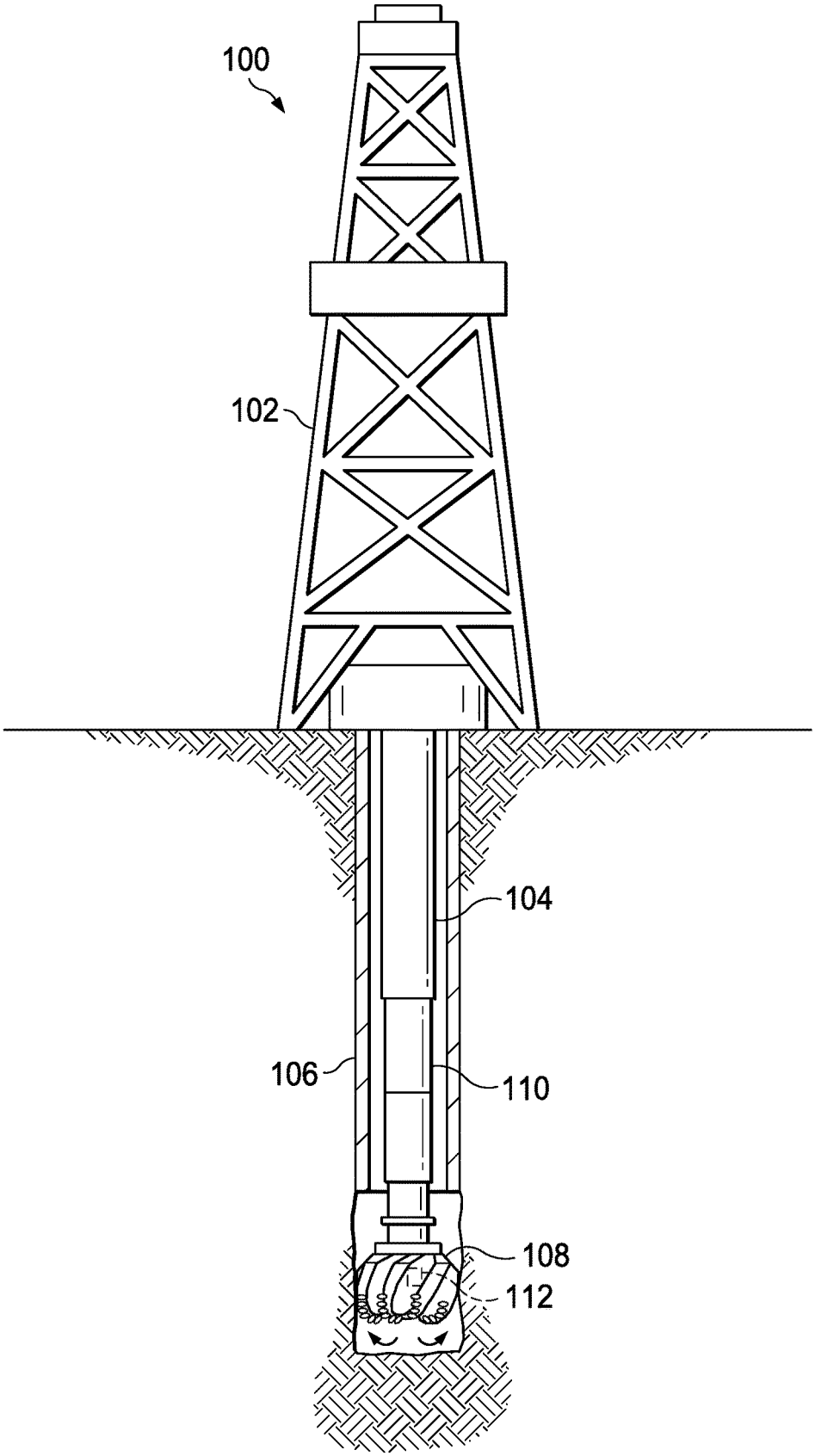
FIG. 1 is a schematic view of a drilling system including a drill bit with a sensor module.

FIG. 1 is a schematic view of a drilling system 100 including a drill string 104 drilling a wellbore 106. The drilling system 100 includes a derrick 102 that supports the drill string 104 within the wellbore 106. The drill string 104 includes drill pipe 110 and a drill bit 108. The drill bit 108 is positioned at the downhole end of the drill string 104 and includes a sensor module 112. The sensor module 112 is embedded in the drill bit 108 and is configured to monitor and predict the wear of the drill bit 108.

Figure 2:
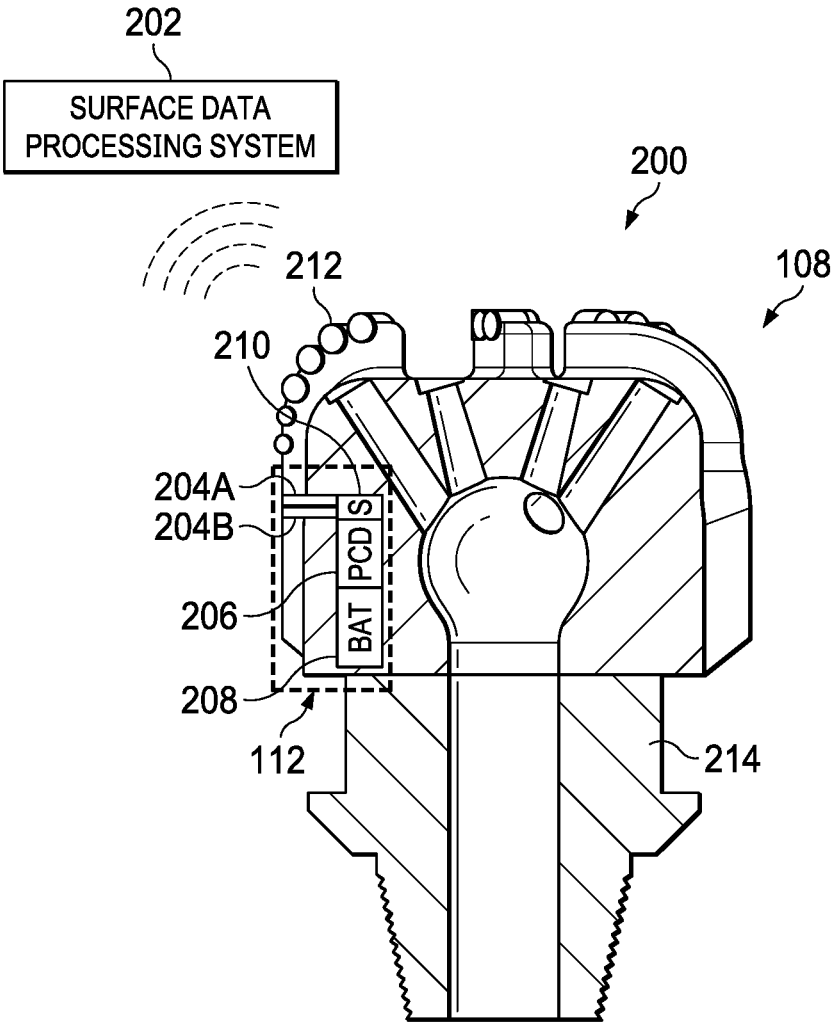
FIG. 2 is a schematic view of an example drill bit with a sensor module.

FIG. 2 is a schematic view of an example of the drill bit 108 with the sensor module 112. The drill bit 108 includes a plurality of blades 212, a body 214, and the sensor module 112. The blades 212 are polycrystalline diamond compact (PDC) drill bit blades. However, some drill bits implementing the condition sensing approach described in this specification have other types of blades and blades formed from other materials. For example, some drill bits use blades inserts as well as tungsten carbide blades and boron nitride blades. The PDC drill bit blades operate to cut into a subsurface formation to form a wellbore.

In the drill bit 108, the sensor module 112 is embedded in the drill bit 108. The sensor module 112 includes an electrical resistance sensor 210, two insulated conductors 204*a*, 204*b*, onboard computer 206 (for example, a printed circuit board) connected to the electrical resistance sensor 210, and a battery 208 to power the onboard computer 206 and the electrical resistance sensor 210. The electrical resistance sensor 210, the onboard computer 206, and the battery 208 are embedded within the body 214 of the drill bit 108. The insulated conductors extend from the electrical resistance sensor 210 through one of the blades 212 of the drill bit 108. For a steel drill bit bodies, the cavity receiving the electrical resistance sensor 210, the onboard computer 206, and the battery 208 can be formed during machining and these components subsequently installed. For matrix drill bit bodies, the electrical resistance sensor 210, the onboard computer 206, and the battery 208 can incorporated during 3D printing or additive manufacturing processes used to form the drill bit bodies.

The two insulated conductors 204*a*, 204*b* extend in parallel from the electrical resistance sensor 210 to a surface of the drill bit 108. The two insulated conductors 204*a*, 204*b* have equal dimensions. The body of the two insulated conductors 204*a*, 204*b* includes copper material or other conductive metal material. Insulating materials (e.g., fiberglass, cellulose, mineral wool, natural fibers, polystyrene, polyisocyanurate, polyurethane, perlite, and combinations thereof) encapsulate the body of the conductors. The insulating layer of the conductors 204*a*, 204*b* is placed between the conductive material of the insulated conductor and the blades 212 and body 214 of the drill bit 108.

The electrical resistance sensor 210 is a piezoresistive sensor. The electrical resistance sensor 210 measures the resistance of a circuit formed by (1) one of the insulated conductors 204*a*, 204*b*, (2) the portion of the blade 212 between the insulated conductors 204*a*, 204*b*, and (3) the other of the insulated conductors 204*a*, 204*b*. As the blades 212 of the drill bit 108 wear away during use, the insulated conductors 204*a*, 204*b* also wear away shortening their length. The shortening of the insulated conductors 204*a*, 204*b* reduces the electrical resistance measured by the electrical resistance sensor 210. Some drill bits use other types of sensors (e.g., an impedance sensor, a resistivity sensor, or a capacitance sensor) to measure the electrical resistance.

During a drilling operation (for example, while the drill bit 108 is drilling into a formation), the electrical resistance sensor 210 senses a change in electrical resistance across the conductors 204*a*, 204*b*, as the length of the conductors decreases. The electrical resistance sensor 210 then transmits the resistance data to the onboard computer 206. The onboard computer 206 includes a data processing system that calculates drill bit wear based the resistance data and transmits the sensed electrical resistance and the calculated drill bit dimensions uphole to a surface data processing system 202 controlling drilling operations. The connection between the onboard computer 206 and the surface data processing system 202 may be a wired connection, a wireless connection, or both. In some cases, the onboard computer 206 transmits the sensed electrical resistance or the calculated drill bit dimensions rather than both uphole to a surface data processing system controlling drilling operations.

The surface data processing system 202 uses the received sensor data and executes algorithms to determine and control the drilling operations. In some implementations, the surface data processing system is configured to receive sensor data from the onboard computer 206 and calculate drill bit dimensions. In some implementations, the surface data processing system is configured to correlate a drilling rate of penetration with the calculated drill bit dimensions. In these implementations, the surface data processing system can calculate lost time associated with reductions in drill bit dimensions and compare the lost time associated with reductions in drill bit dimensions with non-productive time associated with replacing the drill bit. This approach enables the surface data processing system 202 to predict the time until drill bit replacement is required based on a rate of reduction of the drill bit dimensions. Based on the received data and the calculated parameters, modifications to the drilling parameters can be implemented to increase the life of the drill bit or to improve the rate of penetration. Additionally, a determination can be made to trip out the drill bit and replace it with a new one can be based on the predicted end-of-life of the drill bit.

Figure 3:
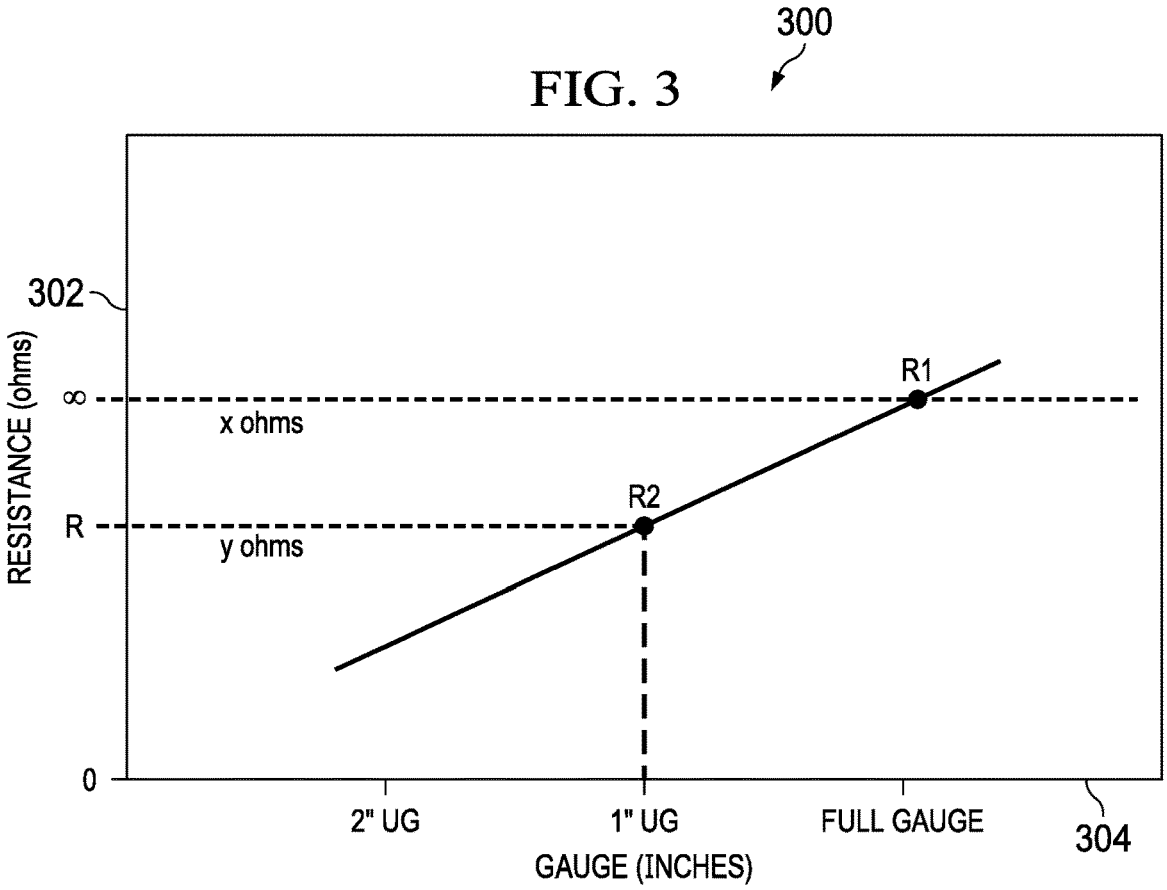
FIG. 3 is a chart showing the relationship between electrical resistance and a drill bit wear.

FIG. 3 is a chart showing an example of the relationship 300 between an electrical resistance 302 and a drill bit wear 304. The chart shows the relationship between drill bit gauge and the resistance sensed by sensor 210. When the drill bit is at full gauge (e.g., no wear) as shown on axis 304, the electrical resistance of the circuit formed by (1) one of the insulated conductors 204*a*, 204*b*, (2) the portion of the blade 212 between the insulated conductors 204*a*, 204*b*, and (3) the other of the insulated conductors 204*a*, 204*b* is at its highest (R1). At full gauge (i.e., before use induced wear), the insulated conductors 204*a*, 204*b* are at their full length and the electrical charge travels its longest distance. As the drill bit wears down (i.e., gauge decreases), the length of the conductors also decreases. For example, as the gauge of the drill decreases from full gauge to 1" under gauge (1 inch under gauge), the resistance decreases from R1 to R2. The relationship between gauge and resistance for a particular configuration of drill bit and associated sensors is determined empirically in a laboratory setting.

Figure 4:
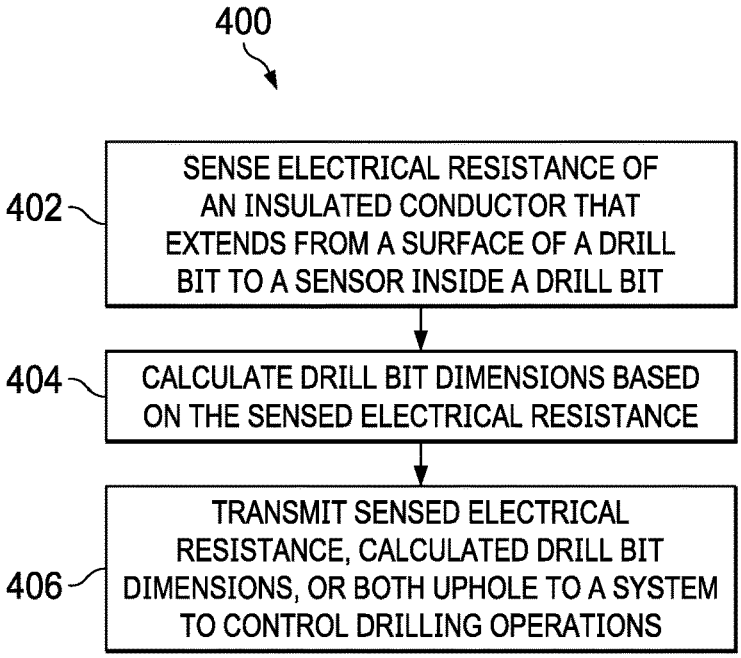
FIG. 4 is a flowchart showing a method for drilling a wellbore.

FIG. 4 is a flowchart of a method 400 for utilizing the change in resistance data sensed by the sensor 210 to control one or more parameters of a drilling operation. During drilling operations, the change in electrical resistance across the insulated conductors is sensed by a sensor (402). The real-time data from the sensor is transmitted to the onboard computer. The onboard computer processes the received data using the data processing system and calculates drill bit dimensions based on the real-time change in resistance data received from the sensor (404). The measured data, the calculated parameters or both are transmitted from the onboard computer to a surface system that controls the drilling operations (406). The surface system can correlate the rate of penetration with the drill bit dimensions, calculate lost time associated with reductions in drill bit dimensions, compare the lost time associated with reductions in drill bit dimensions with non-productive time associated with replacing the drill bit, and/or calculate time until drill bit replacement is required based on a rate of reduction of drill bit dimensions. For example, the surface system updates a drilling plan based on the calculated drill bit dimensions or provides calculated drill bit dimensions as an input to a drilling automation algorithm.

Figure 5:
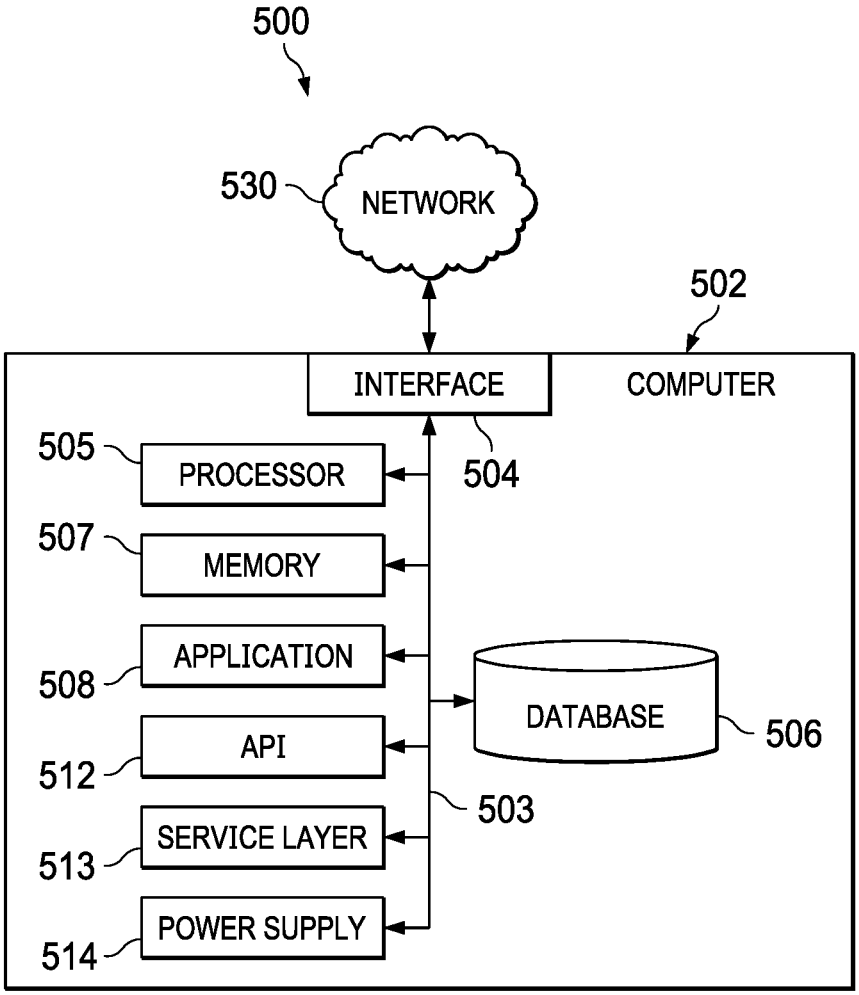
FIG. 5 is a block diagram of an example computer system.

FIG. 5 is a block diagram of an example computer system 500 used to provide computational functionalities associated with described algorithms, methods, functions, processes, flows, and procedures described in the present disclosure, according to some implementations of the present disclosure. The illustrated computer 502 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 502 can include input devices such as keypads, keyboards, and touch screens that can accept user information. Also, the computer 502 can include output devices that can convey information associated with the operation of the computer 502. The information can include digital data, visual data, audio information, or a combination of information. The information can be presented in a graphical user interface (UI) (or GUI).

The computer 502 can serve in a role as a client, a network component, a server, a database, a persistency, or components of a computer system for performing the subject matter described in the present disclosure. The illustrated computer 502 is communicably coupled with a network 530. In some implementations, one or more components of the computer 502 can be configured to operate within different environments, including cloud-computing-based environments, local environments, global environments, and combinations of environments.

At a high level, the computer 502 is an electronic computing device operable to receive, transmit, process, store, and manage data and information associated with the described subject matter. According to some implementations, the computer 502 can also include, or be communicably coupled with, an application server, an email server, a web server, a caching server, a streaming data server, or a combination of servers.

The computer 502 can receive requests over network 530 from a client application (for example, executing on another computer 502). The computer 502 can respond to the received requests by processing the received requests using software applications. Requests can also be sent to the computer 502 from internal users (for example, from a command console), external (or third) parties, automated applications, entities, individuals, systems, and computers. Each of the components of the computer 502 can communicate using a system bus 503. In some implementations, any or all of the components of the computer 502, including hardware or software components, can interface with each other or the interface 504 (or a combination of both), over the system bus 503. Interfaces can use an application programming interface (API) 512, a service layer 513, or a combination of the API 512 and service layer 513. The API 512 can include specifications for routines, data structures, and object classes. The API 512 can be either computer-language independent or dependent. The API 512 can refer to a complete interface, a single function, or a set of APIs.

The service layer 513 can provide software services to the computer 502 and other components (whether illustrated or not) that are communicably coupled to the computer 502. The functionality of the computer 502 can be accessible for all service consumers using this service layer. Software services, such as those provided by the service layer 513, can provide reusable, defined functionalities through a defined interface. For example, the interface can be software written in JAVA, C++, or a language providing data in extensible markup language (XML) format. While illustrated as an integrated component of the computer 502, in alternative implementations, the API 512 or the service layer 513 can be stand-alone components in relation to other components of the computer 502 and other components communicably coupled to the computer 502. Moreover, any or all parts of the API 512 or the service layer 513 can be implemented as child or sub-modules of another software module, enterprise application, or hardware module without departing from the scope of the present disclosure.

The computer 502 includes an interface 504. Although illustrated as a single interface 504 in FIG. 5, two or more interfaces 504 can be used according to particular needs, desires, or particular implementations of the computer 502 and the described functionality. The interface 504 can be used by the computer 502 for communicating with other systems that are connected to the network 530 (whether illustrated or not) in a distributed environment. Generally, the interface 504 can include, or be implemented using, logic encoded in software or hardware (or a combination of software and hardware) operable to communicate with the network 530. More specifically, the interface 504 can include software supporting one or more communication protocols associated with communications. As such, the network 530 or the interface's hardware can be operable to communicate physical signals within and outside of the illustrated computer 502.

The computer 502 includes a processor 505. Although illustrated as a single processor 505 in FIG. 5, two or more processors 505 can be used according to particular needs, desires, or particular implementations of the computer 502 and the described functionality. Generally, the processor 505 can execute instructions and can manipulate data to perform the operations of the computer 502, including operations using algorithms, methods, functions, processes, flows, and procedures as described in the present disclosure.

The computer 502 also includes a database 506 that can hold data for the computer 502 and other components connected to the network 530 (whether illustrated or not). For example, database 506 can be an in-memory, conventional, or a database storing data consistent with the present disclosure. In some implementations, database 506 can be a combination of two or more different database types (for example, hybrid in-memory and conventional databases) according to particular needs, desires, or particular implementations of the computer 502 and the described functionality. Although illustrated as a single database 506 in FIG. 5, two or more databases (of the same, different, or combination of types) can be used according to particular needs, desires, or particular implementations of the computer 502 and the described functionality. While database 506 is illustrated as an internal component of the computer 502, in alternative implementations, database 506 can be external to the computer 502.

The computer 502 also includes a memory 507 that can hold data for the computer 502 or a combination of components connected to the network 530 (whether illustrated or not). Memory 507 can store any data consistent with the present disclosure. In some implementations, memory 507 can be a combination of two or more different types of memory (for example, a combination of semiconductor and magnetic storage) according to particular needs, desires, or particular implementations of the computer 502 and the described functionality. Although illustrated as a single memory 507 in FIG. 5, two or more memories 507 (of the same, different, or combination of types) can be used according to particular needs, desires, or particular implementations of the computer 502 and the described functionality. While memory 507 is illustrated as an internal component of the computer 502, in alternative implementations, memory 507 can be external to the computer 502.

The application 508 can be an algorithmic software engine providing functionality according to particular needs, desires, or particular implementations of the computer 502 and the described functionality. For example, application 508 can serve as one or more components, modules, or applications. Further, although illustrated as a single application 508, the application 808 can be implemented as multiple applications 508 on the computer 502. In addition, although illustrated as internal to the computer 502, in alternative implementations, the application 508 can be external to the computer 502.

The computer 502 can also include a power supply 514. The power supply 514 can include a rechargeable or non-rechargeable battery that can be configured to be either user- or non-user-replaceable. In some implementations, the power supply 514 can include power-conversion and management circuits, including recharging, standby, and power management functionalities. In some implementations, the power-supply 514 can include a power plug to allow the computer 502 to be plugged into a wall socket or a power source to, for example, power the computer 502 or recharge a rechargeable battery.

There can be any number of computers 502 associated with, or external to, a computer system containing computer 502, with each computer 502 communicating over network 530. Further, the terms "client," "user," and other appropriate terminology can be used interchangeably, as appropriate, without departing from the scope of the present disclosure. Moreover, the present disclosure contemplates that many users can use one computer 502 and one user can use multiple computers 502.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A method for drilling a wellbore, the method comprising:

sensing electrical resistance of an insulated conductor extending from a surface of a drill bit to a sensor inside the drill bit;

calculating drill bit dimensions based on the sensed electrical resistance;

correlating a rate of penetration with drill bit dimensions; and transmitting sensed electrical resistance, calculated drill bit dimensions, or both uphole to a system for controlling drilling operations.

2. The method of claim 1, further comprising calculating lost time associated with reductions in drill bit dimensions.

3. The method of claim 2, further comprising comparing the lost time associated with reductions in drill bit dimensions with non-productive time associated with replacing the drill bit.

4. The method of claim 1, further comprising calculating time until drill bit replacement is required based on a rate of reduction of drill bit dimensions.

5. The method of claim 1, further comprising updating a drilling plan based on the calculated drill bit dimensions.

6. The method of claim 1, further comprising providing calculated drill bit dimensions as input to a drilling automation algorithm.

7. A system for drilling wellbores, the system comprising:

a drill bit comprising:

an electrical resistance sensor disposed inside the drill bit;

two insulated conductors extending from a surface of the drill bit to the sensor;

an onboard computer operable to calculate drill bit dimensions based on electrical resistance measured by the electrical resistance sensor; and a data processing system operable to control drilling operations, the data processing system in electronic communication with the onboard computer, wherein the data processing system is configured to receive sensed electrical resistance, calculated drill bit dimensions, or both from the onboard computer and wherein the data processing system comprises algorithms to correlate drilling rate of penetration with drill bit dimensions.

8. The system of claim 7, wherein each of the insulated conductors comprises copper with insulating materials disposed between the copper and a body of the drill bit.

9. The system of claim 8, wherein the two insulated conductors have the same dimensions and extend in parallel from the surface of the drill bit to the sensor.

10. The system of claim 7, wherein the data processing system further comprises algorithms to calculate lost time associated with reductions in drill bit dimensions.

11. The system of claim 7, wherein the data processing system further comprises algorithms to compare the lost time associated with reductions in drill bit dimensions with non-productive time associated with replacing the drill bit.

12. The system of claim 7, wherein the data processing system further comprises algorithms to calculate time until drill bit replacement is required based on a rate of reduction of drill bit dimensions.

13. The system of claim 7, wherein the onboard computer is a printed circuit board.

14. The system of claim 7, further comprising a battery electrically connected to the onboard computer and the sensor.

* * * * *